US008623271B2

(12) United States Patent
Guest

(10) Patent No.: US 8,623,271 B2
(45) Date of Patent: Jan. 7, 2014

(54) APPARATUS FOR INDUCING FLOW IN A MOLTEN MATERIAL

(75) Inventor: Graham John Guest, Wombourne (GB)

(73) Assignee: Solios Thermal Limited (GB)

( * ) Notice: Subject to any disclaimer, the term of this patent is extended or adjusted under 35 U.S.C. 154(b) by 294 days.

(21) Appl. No.: 13/124,623

(22) PCT Filed: Oct. 20, 2009

(86) PCT No.: PCT/GB2009/002492
§ 371 (c)(1),
(2), (4) Date: May 24, 2011

(87) PCT Pub. No.: WO2010/046633
PCT Pub. Date: Apr. 29, 2010

(65) Prior Publication Data

US 2012/0013055 A1 Jan. 19, 2012

(30) Foreign Application Priority Data

Oct. 25, 2008 (GB) ..... 0819685.9

(51) Int. Cl.
*C21C 7/00* (2006.01)

(52) U.S. Cl.
USPC ..... 266/234; 266/241

(58) Field of Classification Search
USPC ..... 266/241, 234, 287
See application file for complete search history.

(56) References Cited

U.S. PATENT DOCUMENTS

| | | | | |
|---|---|---|---|---|
| 2,711,436 | A * | 6/1955 | Jones et al. | 373/146 |
| 5,809,057 | A | 9/1998 | Benz et al. | |
| 6,391,247 | B1 | 5/2002 | Heine et al. | |
| 2004/0135297 | A1 * | 7/2004 | Houghton | 266/234 |
| 2009/0129197 | A1 | 5/2009 | Isidorov | |

FOREIGN PATENT DOCUMENTS

| | | | |
|---|---|---|---|
| CN | 101082081 | A | 12/2007 |
| GB | 1501061 | | 2/1978 |
| GB | 1507444 | | 4/1978 |
| GB | 1587338 | | 4/1981 |
| JP | 590209975 | A | 2/1984 |
| WO | 03/106908 | A1 | 12/2003 |
| WO | 2007120028 | A1 | 10/2007 |
| WO | 2009006775 | A1 | 1/2009 |

* cited by examiner

*Primary Examiner* — Scott Kastler
(74) *Attorney, Agent, or Firm* — Chernoff Vilhauer LLP

(57) ABSTRACT

Apparatus for inducing flow in a molten material comprises a refractory lined vessel (10) for containing a molten material with an aperture (35, FIG. 3) in the refractory lining. A mounting plate (40, FIG. 4) of non-magnetic material is removably mounted to the vessel over the aperture and an electromagnetic induction unit (14) is mounted adjacent an exterior face of the mounting plate. A cooling system is provided for cooling the mounting plate. The mounting plate may have vanes (72, FIG. 6) on an outer surface to define cooling channels (74, FIG. 6) through which a cooling fluid can flow. The vanes may follow a non-linear path and the cooling fluid may be air.

17 Claims, 7 Drawing Sheets

APPARATUS FOR INDUCING FLOW IN A MOLTEN MATERIAL

The present application relates to an apparatus for inducing flow in a molten material. In particular, but not exclusively, the invention relates to apparatus comprising an arrangement for mounting an electromagnetic induction stirring unit to a vessel for containing molten materials. The invention also relates to a mounting plate for mounting an electromagnetic induction stirring unit to a vessel for containing molten materials.

It is known to provide furnaces for the melting and refining of metal materials, including aluminium, or other materials. Furnaces have also been used to recycle scrap metal.

It is accepted that the melting and refining process can be improved by stirring the molten metal in the furnace. Stirring the molten metal distributes heat more evenly throughout the melt and so improves the efficiency of the process. Where additional solid-state materials, such as scrap metal for recycling and/or additives, are introduced into the melt in the furnace, stirring can assist in mixing the solid state material with the melt more quickly.

It is known to provide a stirring apparatus in the form of an electromagnetic induction unit (a type of linear induction motor) positioned underneath the furnace in a horizontal plane adjacent a bottom wall of the furnace. The magnetic field created by the induction unit acts through a relatively thick steel plate and internal refractory lining on the bottom of the furnace to stir the molten material slowly in a horizontal plane, in an attempt to disperse the heat evenly throughout the melt. However, it is believed that such a treatment of molten metal may have disadvantages at least in certain applications. For example, when additional scrap metal material or alloy additives such as silicon are introduced into the furnace on top of the melt, the stirring action provided by the electromagnetic induction unit does not contribute greatly to mixing the new scrap metal material/additives evenly throughout the melt. Often the scrap metal material/additive will be quite light (particularly a silicon additive) and will simply float on the surface of the melt as it is stirred around in a horizontal plane rather than, for example, being dragged downwardly into the molten metal where it can be melted and mixed much more quickly and effectively. Once again, scrap metal with a high surface area to mass ratio (for example shredded aluminium drink cans) will simply float on the top of the melt and become oxidised rather than being submerged within the bath to be melted down and recycled in an efficient manner.

Furthermore, in order to stir the metal, it is necessary that the induction unit provide a deep magnetic field that propagates through the furnace construction to penetrate into the molten material in the furnace. This requires the induction device to be operated at very low frequencies, typically 1 Hz. Consequently the speed of stirring is relatively low.

The applicant has proposed in WO 03/106668 to mount an electromagnetic induction unit on an angled wall of a furnace port to induce a flow or stirring in the molten metal having both a vertical and a horizontal component. This arrangement can be used to help draw scrap materials or additives down into the molten material to aid in mixing. As described, the electromagnetic induction unit sets up a circulating flow of material in the furnace by creating a downward flow of material at one end. Because the electromagnetic field does not have to penetrate as far into the molten material as with the previously known arrangements, it is possible to use an electromagnetic induction unit capable of operating at frequencies up to 60 Hz but which produces a shallower magnetic field. This is advantageous as it enables relatively fast flow rates to be achieved, leading to improved flexibility in mixing. The direction of the magnetic field can also be reversed and the system used to extract molten material from the furnace by pulling the molten meal up the angled wall and into an extraction chute.

In the applicant's proposed system, the electromagnetic induction unit operates at a relatively high frequency when compared with the previously known system and the depth of the magnetic field is comparatively shallow. As a result, it is not possible to mount the induction unit to the vessel using a thick steel plate and refractory construction as used in the previously known arrangement, as this would prevent the magnetic field from penetrating into the molten material to a sufficient depth. Instead, the induction unit is mounted to the vessel by means of a thin metal carbide plate construction made up of a number of separate tiles. Whilst this method of mounting the induction unit has proved to be effective in use, it is complex and time consuming to construct. A further drawback is that the furnace cannot be used with the induction unit removed unless the induction unit is replaced by a substitute plate to ensure the integrity of the furnace. Accordingly, if there is a need to repair or replace the induction unit, it is often necessary to shut the furnace down.

There is then a need for an improved apparatus for inducing flow in a molten material in which some or all of the shortfalls of the prior known arrangements are overcome, or at least mitigated. In particular, there is a need for improved apparatus for inducing flow in a molten material having an improved arrangement for mounting an electromagnetic stirring unit to a vessel for containing a molten material.

There is also a need for am improved mounting plate for mounting and an electromagnetic stirring unit to a vessel for containing a molten material which overcomes, or at least mitigates, some or all of the shortfalls of the prior known mounting plate arrangements.

In accordance with a first aspect of the invention, there is provided apparatus for inducing flow in a molten material, the apparatus comprising a refractory lined vessel for containing a molten material, an aperture or region of reduced thickness in the refractory lining, a mounting plate of non-magnetic material removably mounted to the vessel over the aperture or region of reduced thickness, an electromagnetic induction unit mounted adjacent an exterior face of the mounting plate and a cooling system for cooling the mounting plate in use.

The cooling system may comprise an arrangement for inducing a flow of cooling fluid between the electromagnetic induction unit and the mounting plate. The cooling system may comprise a plurality of cooling channels through which the cooling fluid flows in use. The mounting plate, at least where it extends over the aperture or region of reduced thickness in the refractory lining, may have a continuous inner surface region and an outer surface region with a plurality of spaced vanes defining the cooling channels. Some of the vanes may follow a non-linear path, at least in an area of the mounting plate through which the magnetic field generated by the induction unit passes in use. The non-linear path may be a curved or zigzag path across said area. The inner surface region and the vanes may be integrally formed from a single piece of material.

The mounting plate may be made of austenitic steel.

The mounting plate may have a thickness in the range of 10 to 30 mm, and preferably in the range of 15 to 25 mm and more preferably in the range of 18 to 22 mm. The vanes may have a height in the range of 5 to 25 mm, and preferably in the range of 10 to 20 mm, and more preferably in the range of 13 to 17 mm.

The mounting plate may be part of a mounting plate assembly for mounting the induction unit to the vessel.

The mounting plate may have a recess in the outer surface region fluidly connected with an inlet end of the fluid-cooling channels and the mounting plate assembly may comprise a cowling attached to the mounting plate for directing a flow of fluid into the recess from a fluid-flow source. The cowling may comprise means for mounting at least one cooling fan, the cowling being configured to direct air from the at least one fan into the recess.

The mounting plate assembly may include a cover member mounted to an outer face of the mounting plate, the cover member defining an aperture through which at least an area of the mounting plate over which the cooling channels and the vanes extend is exposed, the electromagnetic induction unit being received in the aperture so that a face of the unit abuts the vanes. Where the mounting plate assembly has a cowling, the cowling may be an integral part of the cover member.

The mounting plate assembly may include a further plate extending at an angle from one end of the mounting plate.

The apparatus may comprise a frame mounted to the vessel about the aperture, the mounting plate being removably mounted to the frame.

The apparatus may include at least one refractory tile positioned inboard of the mounting plate, the at least one tile engaging with the refractory lining and extending across the aperture in the refractory lining. The, or each, refractory tile may be thinner than the refractory lining surrounding the aperture. Insulation material may also be provided between the at least one refractory tile and the mounting plate.

The apparatus may include a framework for mounting the induction unit to the vessel for pivotal movement between an operative position, in which a face of the induction unit is located adjacent the mounting plate, and an inoperative position, in which the induction unit is spaced from the mounting plate.

Where the mounting plate has plurality of spaced vanes, a face of the electromagnetic induction unit may abut the vanes when the electromagnetic induction unit is mounted in an operative position.

In one embodiment, the vessel is a furnace. In an alternative embodiment, the vessel is a furnace port, the port comprising an inclined wall to which the induction unit is mounted. The port may be removably mountable to a wall of a furnace.

In accordance with a second aspect of the invention, there is provided a mounting plate for mounting an electromagnetic induction unit to the wall of a vessel for containing molten material, the mounting plate being made of non-magnetic material and comprising an inner surface region and an outer surface region having a plurality of spaced vanes to define cooling channels extending over at least an area of the mounting plate, in which at least some of vanes follow a non-linear path across all or part of said area. At least some of the vanes may follow a curved or zigzag path across said area.

The inner surface region and the vanes may be integrally formed from a single piece of material.

The mounting plate may be made of austenitic steel.

The mounting plate may form part of a mounting plate assembly comprising a cover mounted to an outer surface of the plate, the cover defining a central aperture through which at least a part of some of the vanes is exposed and a plenum assembly for directing a flow of fluid through the cooling channels.

An embodiment of the invention will now be described, by way of example only, with reference to the accompanying drawings, in which.

Figure 1:
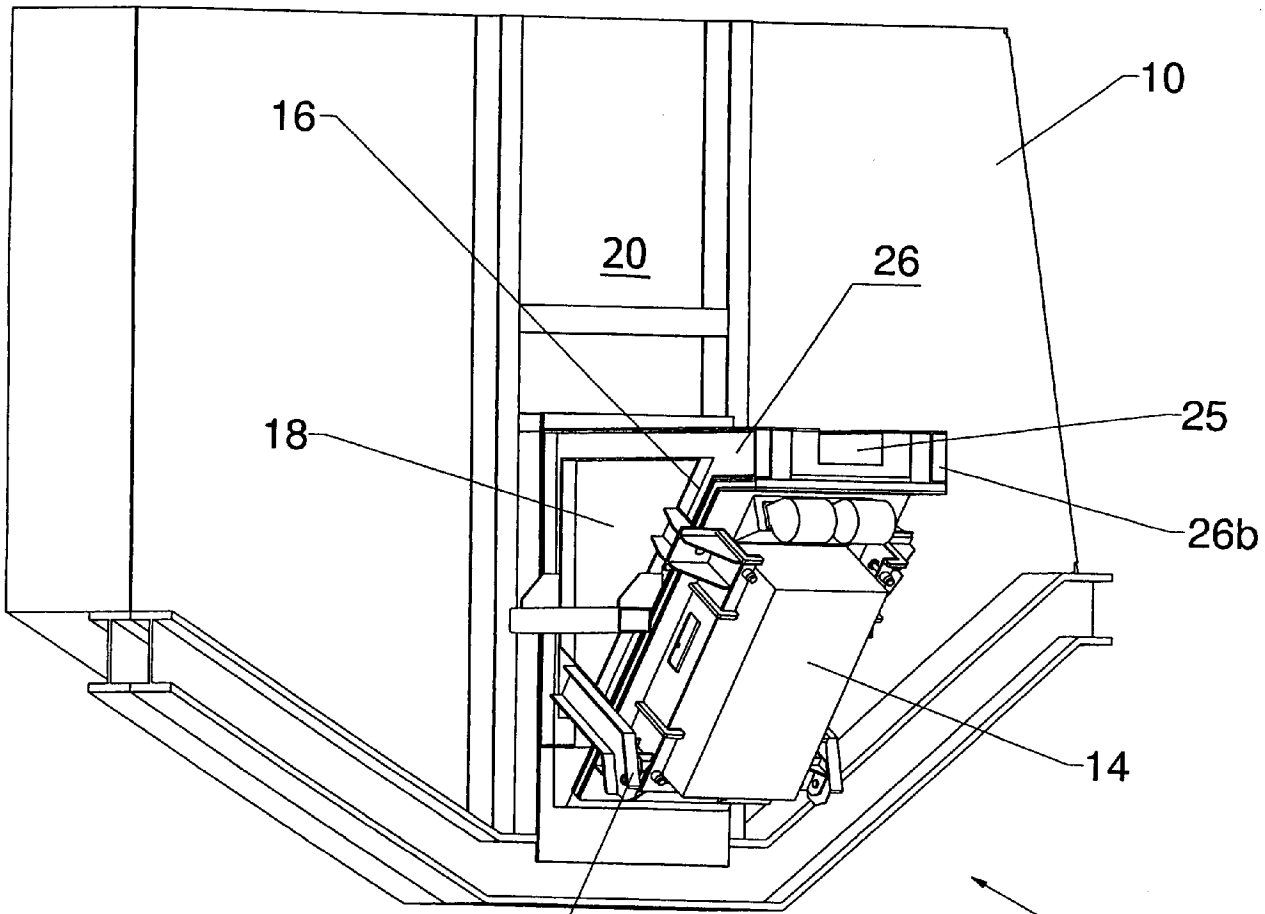
FIG. 1 is a fragmentary perspective view showing part of a furnace with a furnace port to which is mounted an electromagnetic induction device.

A furnace 10 has flow inducement and/or stirring apparatus, indicated in general at 12 in FIG. 1, which comprises an electromagnetic induction unit 14 (in the form of a linear induction motor) mounted to an inclined wall 16 of a cradle or port 18 which is connected with a vertical end wall 20 of the furnace.

The general configuration and operation of the stirring/flow inducement apparatus 12 is similar to that described in the applicant's International patent application published as WO 03/106668, to which the reader should refer for a detailed description of its construction and operation. The content of WO 03/106668 is hereby incorporated by reference in its entirety, including in particular but not exclusively, details of the construction and operation of the stirring apparatus and the flow of molten material which can be induced using the apparatus 12.

In cross-section, the port 18 is shaped generally as a right-angled triangle, with the inclined wall 16 being angled at approximately 55° to the vertical end wall 20 of the furnace. However, the port need not be constructed as a right angled triangle and the angle of the inclined wall can be varied to suit the particular application and could, for example, be anywhere in the range of 30° to 66°.

The port 18 is mounted about an aperture 22 in the vertical end wall 20 of the furnace. The upper end of the port 18 in the embodiment shown is extended to define a channel portion 24 in which is formed a channel 25. In use, the channel 25 is in fluid connection with the interior of the furnace by means of a flow passage through the port and the aperture 22. The channel 25 can be extended outwardly by connecting additional channel members to form an extraction chute. In some embodiments, not shown, the port 18 does not have a channel portion 24, in which case it may be similar to the arrangement described in relation to FIGS. 1 to 3 in WO 03/106668.

In the arrangements described in WO 03/106668, the port 18 is permanently attached to the vertical end wall 20 of the furnace using refractory techniques. However, in the present embodiment the port 18 is removably attached to the furnace. This is advantageous as it enables the port 18, including the mounting arrangement for the induction unit 14, to be assembled at a remote location from the furnace and the complete port assembly then attached to a furnace in-situ. The provision of a removable port also makes it possible to have one or more spare ports 18 ready assembled to enable a damaged port to be replaced very quickly should the need arise. This significantly reduces the downtime for the furnace when compared with the prior known arrangements in which a damaged port would have to be dismantled, repaired and reassembled in-situ.

The port 18 has a frame 26 comprising opposing side members 26*a*, 26*b* each of which is generally triangular in shape. Extensions 26*c* project outwardly from the upper, outer (in use) corner of the side members to define the channel portion 24. Side wall panels 28 (only one of which is shown) are attached to the inner surfaces of the side members 26*a*, 26*b* to form the side walls of the port and a rectangular back plate 30 is mounted to the rear end faces of the side members 26*a*, 26*b* for location on the vertical end wall 20 of the furnace about the aperture 22. The back plate 30 has an aperture that aligns with the aperture 22 in the vertical wall 20 of the furnace. The back plate 30 and the frame side members 26*a*, 26*b* can be mounted to the end wall 20 of the furnace by any suitable method. For example, they may be mounted by means of studs (not shown) on the furnace wall 20 or other fasteners which are received in corresponding holes 31 in back plate 30 and the inner vertical lengths 26*d* of the side members 26*a*, 26*b*. A suitable seal may be provided between the back plate 30 and the wall 20 of the furnace.

The side members 26*a*, 26*b*, the side wall panels 28 and the back plate 30 can be made of any suitable material such as steel, which may be austenitic steel. The interior of the port 18 is lined with refractory materials 34 to define the channel 25 and the passageway fluidly connecting the channel 25 with the interior of the furnace. The refractory materials also define an opening or aperture 35 adjacent the angled wall 16 of the port. The refractory lining 34 includes a base section 34*a* which locates at the lower end of the port and a channel section 34*b* which locates at the upper end of the port and which lines the channel portion 24. The refractory lining 34 also includes two sidewall sections 34*c* that locate on the base section 34*a* and line the sidewalls of the port. A pair of plates 45 are secured to the upper surfaces of the side frame members 26*a*, 26*b* to hold the sidewall sections 34*c* and the channel section 34*b* of the refectory material in position.

Figure 4:
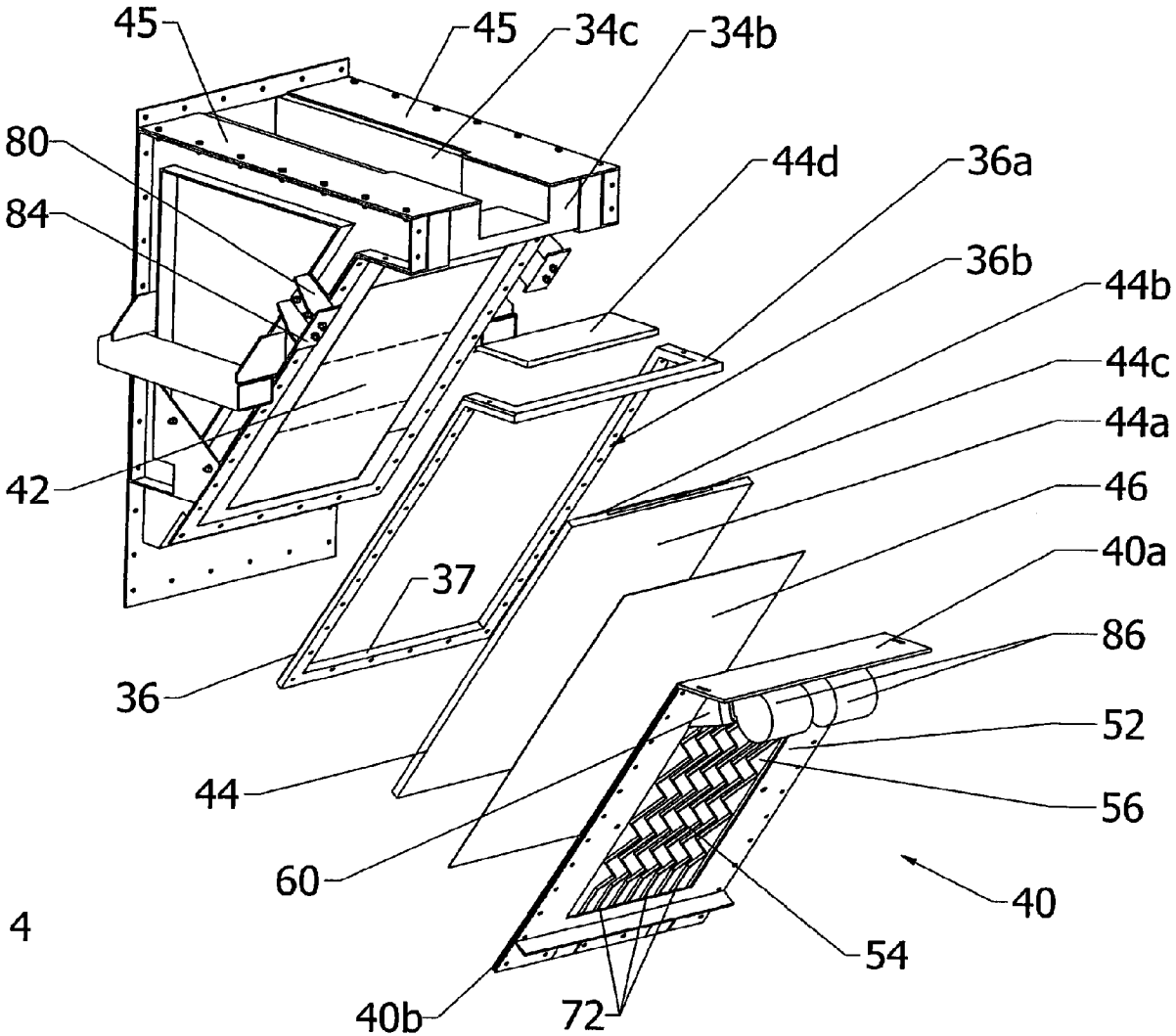
FIG. 4 is a further exploded, perspective view of the port shown in FIGS. 1 and 2, showing part of an apparatus for mounting an electromagnetic induction device to the port.

As can be seen best from FIG. 4, an arrangement for mounting the electromagnetic induction unit 14 to the port 18 includes a frame member 36 which is mounted to the inclined outer faces of the side members 26*a*, 26*b* and to the lower faces of the extensions 26*c* so as to surround the opening 35 in the refractory materials lining the port. The frame member 36 can be made of any suitable material such as steel and may be secured to the side members 26*a*, 26*b* of the port frame by any suitable means, such as by welding or by means of suitable fasteners.

The frame member 36 is generally rectangular in shape but with an upper section 36*a* which is angled relative to a main section 36*b* of the frame to fit under the channel portion 24. In embodiments where the port 18 has no channel portion 24, the frame member 36 may be a simple rectangular frame.

The frame member 36 defines an opening or window 37 surrounding the aperture 35 in the refractory lining 34 of the port 18 through which various components of the induction unit mounting arrangement can be inserted. These include one or more refractory tiles 42, an insulation layer 44 and a molten material leakage sensor 46.

The refractory tiles 42 locate in a recess 43 defined in the refractory lining 34 of the port surrounding the opening 35 so as to extend across and close the aperture 35. The three tiles are positioned with a lower tile locating in recess portion 43*a* in the base section 34*a* of the refractory material, an upper tile engaging with a lower edge 48 of the upper channel section 34*b* and the third tile located between the other two. Whilst three tiles 42 are used in the present embodiment this is not essential and one, two, or more than three tiles can be used as desired in order to cover the aperture in the refractory lining of the port.

The refractory tiles 42 are thinner than the refractory lining 34 surrounding the aperture and may be formed of an abrasion resistant composite ceramic material, though other durable refractory materials can be used. The base section 34*a* and the channel section 34*b* of the refractory lining may also be made of an abrasion resistant composite ceramic material, though again any suitable refractory materials can be used. The base of the channel section 34*b* may be of the same thickness as the tiles. The refractory tiles 42 can be considered to define a region of reduced thickness in the refractory lining. The base of the channel section 34*b* can also be considered to be part of the region of reduced thickness in the refractory lining.

Typically, the refractory tiles 42 will be inserted into the recess 43 surrounding the aperture 35 in the refractory lining through the window 37 after the frame 36 has been secured to the port. However, the tiles 42 could be positioned within the aperture before the frame 36 is mounted in position if desired.

A layer of insulation 44 is inserted into the opening 37 in the frame 36 to abut the outer surfaces of the tiles 42 and the horizontal lower surface of the channel section 34*b* of refectory material. The layer of insulation includes a main insulation plate member 44*a* which is positioned adjacent the tiles 42. The main insulation plate member can be made of any suitable material but in the present embodiment comprises a ceramic carrier 44*b* in which various insulation materials 44*c* are held. The insulation materials extend over a width which is at least the same as the opening 35 in the refectory lining 34 of the port. Any suitable insulation materials can be used and are selected based on their thermal and mechanical properties measured against the calculated requirements in any particular application. In the present embodiment, the insulation material contains 80% or more of alumina.

The use of a ceramic carrier 44*b* for the insulation materials provides stability and accurate insulation compressions. However, the use of a ceramic carrier is not essential and the insulation layer could be provided by means of any suitable insulation materials such as a combination of ceramic board and insulation blanket.

A further insulation plate 44*d* is positioned within the angled portion 36*a* of the frame 36 adjacent the horizontal lower surface of the channel section 34*b* of refectory material. The further insulation plate 44*d* can be made of any suitable material including any of those discussed above in relation to the main insulation plate 44*a*.

The molten material leakage sensor 46 is positioned inside the frame 36 adjacent the outer surface of the insulation plate member 44*a*. The sensor can be of any suitable form and in the present embodiment comprises a sensor net having a mesh of wires embedded in a substrate. The sensor is used as part of a sensor circuit to detect a leakage of molten materials, in particular molten metal such as aluminium, in a known manner. Other forms of sensor can be used or the sensor could be omitted in certain applications.

The window or aperture 37 in the frame member 36 is closed by a mounting plate assembly 40 which is secured to the outer surface of the frame member 36. The mounting plate assembly 40 can be secured in position using any suitable means, such as releasable fasteners including studs or bolts. The mounting plate assembly 40 is fastened tightly to the frame member 36 so as to compresses the refractory tiles 42, the insulating layer 44 and the sensor 46 between itself and the refractory materials 34 lining the interior of the port. The frame member 36 acts as a spacer to determine the amount of compression the tiles 42, the insulating layer 44 and sensor 46 are placed under and the thickness of the frame is accordingly selected to provide the desired amount of compression dependent on the materials and dimensions of the tiles 42, insulation layer 44 and sensor 46 (where provided).

Figure 2:
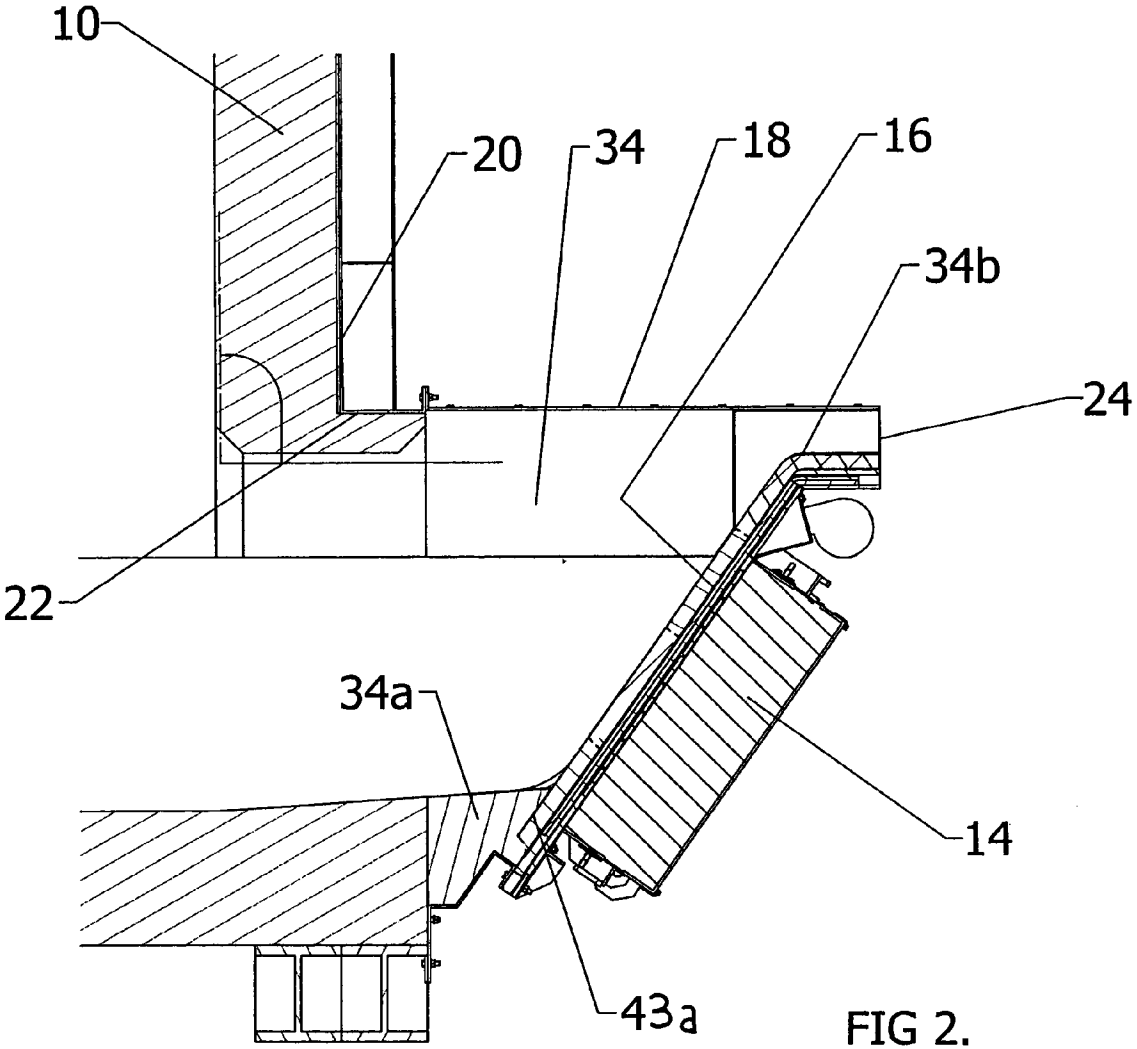
FIG. 2 is a cross sectional view through the port and part of the furnace as shown in FIG. 1.
Figure 3:
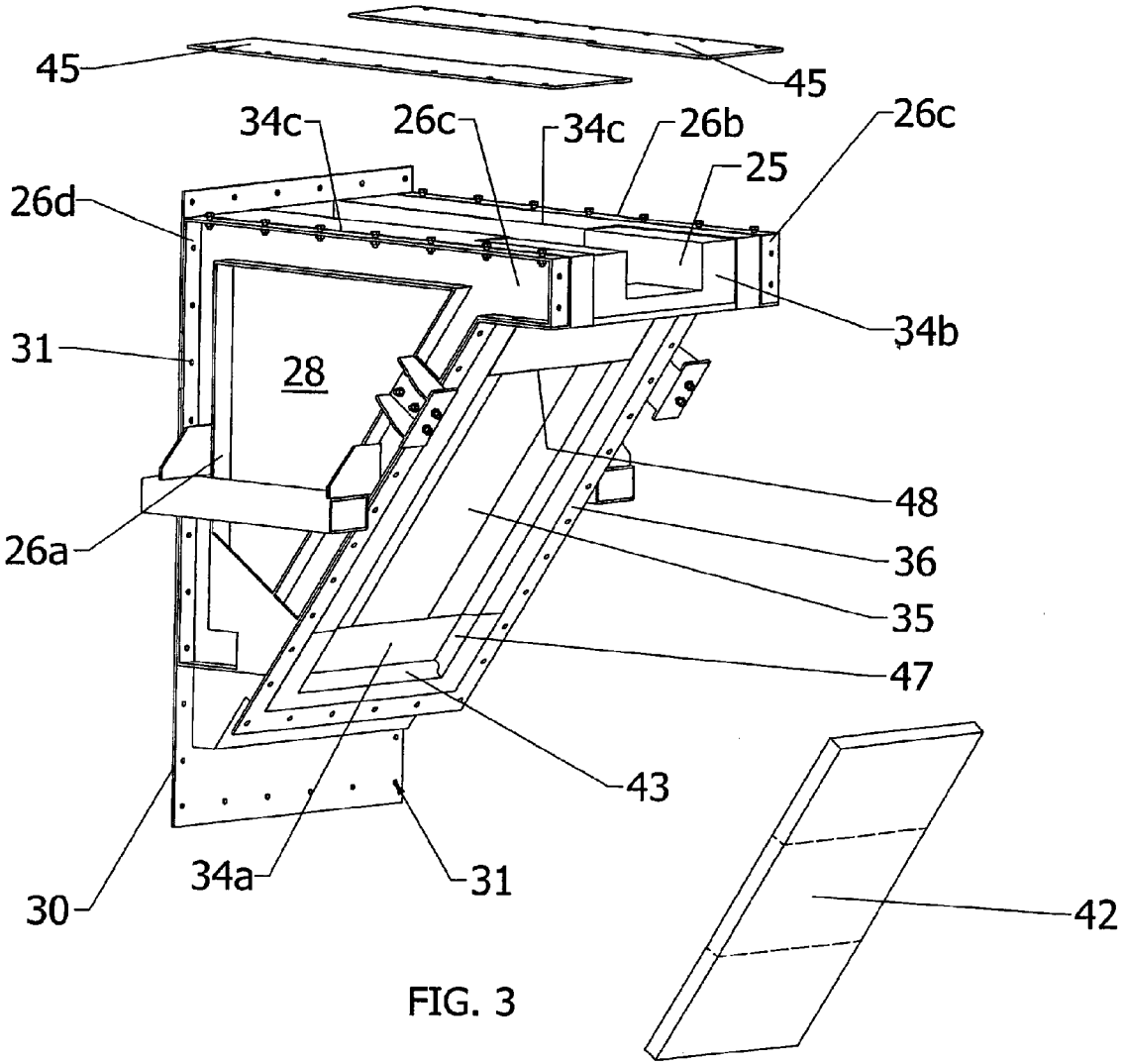
FIG. 3 is an exploded, perspective view of the port shown in FIGS. 1 and 2.
Figure 5:
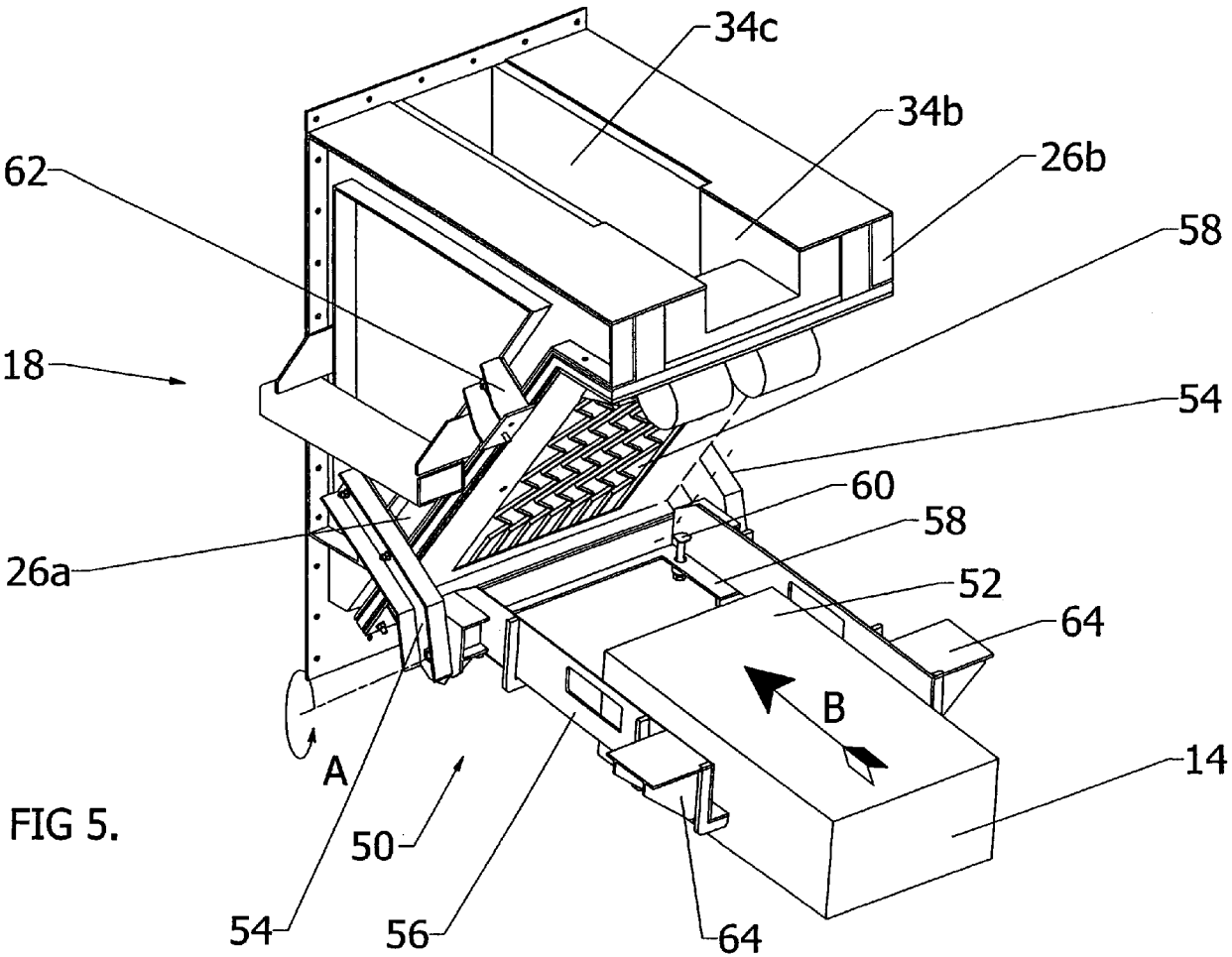
FIG. 5 is a further perspective view of the port shown in FIGS. 1 and 2, showing a frame for pivotably mounting an electromagnetic induction device to the port.

As illustrated in FIG. 5, the electromagnetic induction unit 14 is mounted to the port 18 by means of a framework indicated generally at 50. The framework 50 is arranged to mount the induction unit 14 to the port so that it can be pivoted between an operative position as shown in FIGS. 1 and 2 and an inoperative position as shown in FIG. 5. In the operative position, an inner face 52 of the induction unit 14 is held in abutment with the mounting plate assembly 40. In the inoperative position, as shown in FIG. 5, the induction unit 14 is spaced from the mounting plate assembly 40. This arrangement is advantageous as the induction unit 14 is heavy and the pivotable framework enables the induction unit 14 to be safely mounted to the port 18 and moved to the operative position in a controlled manner. In addition, the induction unit 14 can be moved to the inoperative position for inspection or to enable work to be carried out on it without having to completely remove the unit 14 from the port.

The framework 50 includes lower supporting brackets 54 on either side of port 18, each mounted to a respective one of the side frame members 26*a*, 26*b*. A generally U shaped frame 56 is pivotably mounted to the lower brackets 54 at one end and is configured to surround the induction unit 14 on three sides. Mounting lugs (not shown) on the induction unit have holes that align with holes in a flange 58 on the frame 56 to receive fasteners 60 for securing the induction unit 14 to the frame. As shown in FIG. 5, the induction unit can be inserted into the frame 56 in direction of arrow B and secured in position.

Upper support brackets 62 are also mounted to the frame members 26*a*, 26*b* on either side of the port 18. The upper support brackets are positioned so as to align with corresponding brackets 64 on the upper end of the frame 56 when the induction unit 14 is pivoted to the operative position as indicated by arrow A in FIG. 5. The upper support brackets 62 and the corresponding brackets 64 are secured together using suitable fasteners to hold the induction unit 14 in the operative position.

Co-operating abutments (not shown) are provided on the lower support brackets and the frame 56 to hold the frame generally horizontally when it is in the inoperative position, in order that the induction unit 14 can be easily and safely mounted in or removed from the frame 56.

The upper and lower support brackets 54, 62 are attached directly to the framework 26 of the port structure. This transfers the stress caused by mounting the inductor unit through the framework to the furnace and so isolates the ceramic components in the mounting arrangement, such as the tiles 42, the insulating plate member 44*a* and the sensor 46, from the inductor unit 14 mounting stresses.

The mounting plate assembly 40 physically closes-off the port window 37 and the aperture 35 in the refractory lining and provides structural rigidity whilst offering a minimum of opposition to the magnetic field generated by the induction unit 14. The mounting plate assembly 40 has an upper section 40*a* that is angled relative to a main section 40*b* for location under the channel portion 24 of the port. The main section 40*b* of the mounting plate assembly locates on the main section 36*b* of the frame member and forms, in effect, the outer surface of the inclined wall 16 of the port and provides an exterior closure for the aperture 35 in the refractory lining 34.

Figure 6:
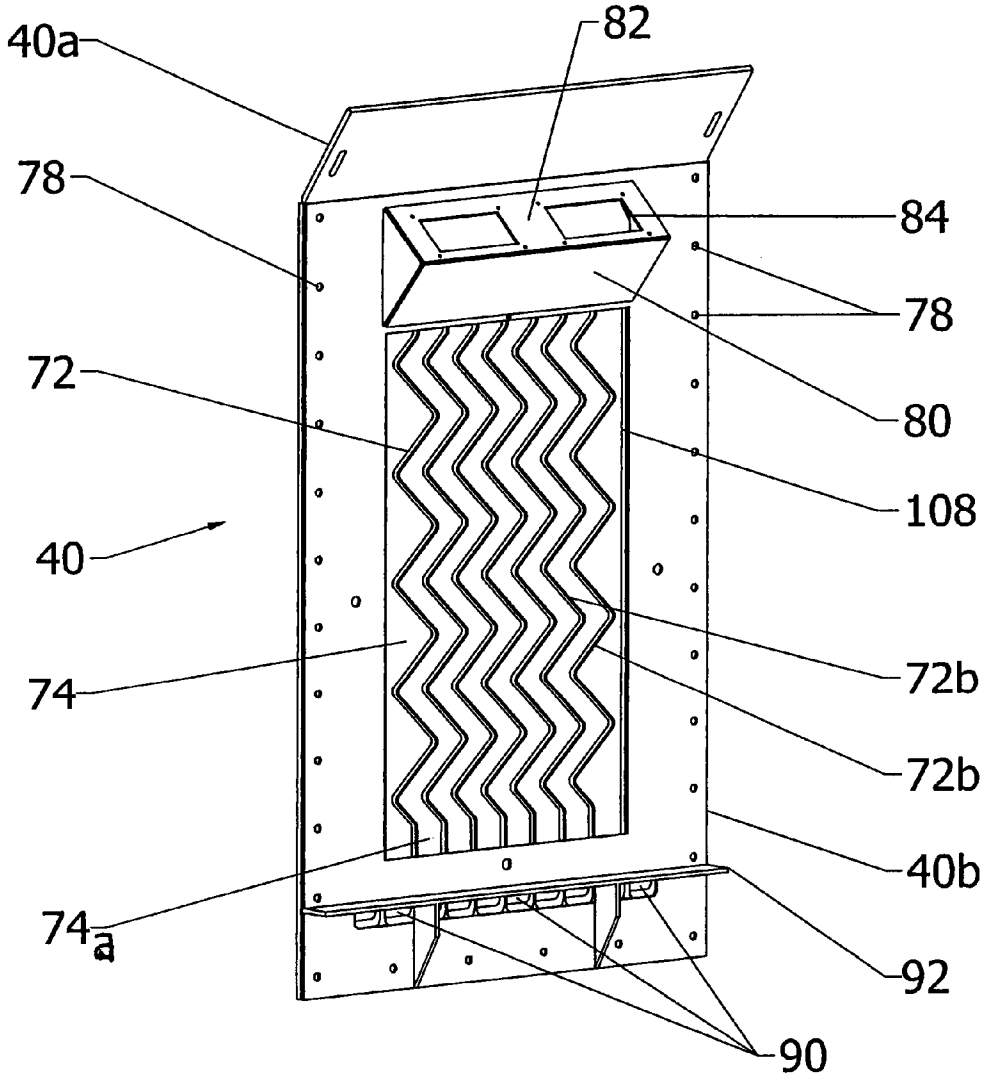
FIG. 6 is a perspective view of a mounting plate assembly which forms part of the apparatus of FIG. 4; and, FIG. 7 is an exploded, perspective view of the mounting plate assembly of FIG. 6.
Figure 7:
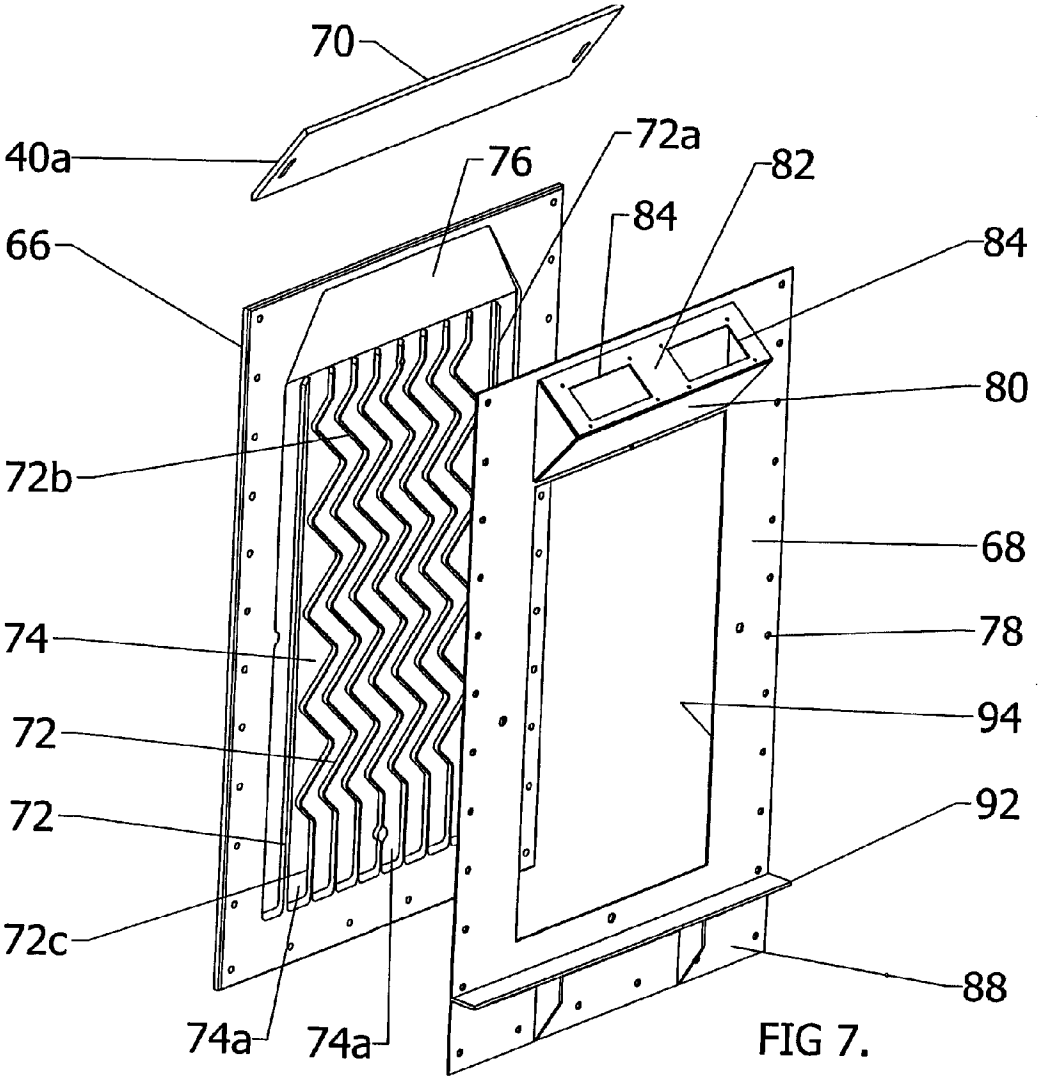

The construction of the mounting plate assembly 40 can be seen more clearly from FIGS. 6 and 7.

The mounting plate assembly 40 in the present embodiment has three main component parts, a main mounting plate 66, a cover member 68 and a further plate 70. The mounting plate 66 and the cover member 68 together form the main section 40*b* of the mounting plate assembly 40, whilst the further plate 70 forms the upper section 40*a*. All the component parts of the mounting plate assembly are made from non-magnetic materials. In the present embodiment, the parts are all made from austenitic steel and are welded together.

The main mounting plate 66 is produced from a single, rectangular plate of austenitic steel, or other non-magnetic material. An outer surface region of the plate 66 is machined to produce vanes 72 which define air-cooling channels 74. An inlet recess 76 is also machined into the outer surface region of the mounting plate at one end of the channels 74. The recess fluidly interconnects all of the channels 74 so that cooling air directed into the recess can flow along each of the cooling channels.

In the present embodiment, the inlet recess 76 is formed at an end of the channels that is uppermost in use so that the air flows downwardly through the channels. However, the direction of airflow through the channels 74 could be reversed so that it flows from the bottom to the top. Indeed, the channels 74 need not extend in a generally vertical direction but could be aligned generally horizontally so that the air flows from side to side across the inductor unit 14 or in any other direction.

The mounting plate 66 can be of any suitable thickness depending on the application and the depth of the magnetic field generated by the inductor 14. In the present embodiment, the mounting plate has an overall thickness of 20 mm with the cooling channels 74 and the inlet recess 76 having a maximum depth of about 15 mm. Thus the mounting plate 66 has an inner surface region with a minimum thickness of 5 mm at the base of the channels so that the plate forms a closure when mounted to the frame 36. However, the thickness of the mounting plate 66 can be varied as required and could be anywhere from 10 to 30 mm and the maximum depth of the cooling channels 74 (or height of the vanes 72) can be anywhere from 5 to 25 mm dependent on the thickness of the plate. The thickness of the plate 66 and the depth of the cooling channels 74 is selected to ensure that the mounting plate 66 has an unbroken or continuous inner surface region which completely covers the aperture or window 37 in the frame member 36 providing a physical barrier between the induction unit 14 and the refractory materials.

The cover member 68 is in the form of a rectangular frame that locates on a border region of the mounting plate 66. An array of mounting holes 78 are provided along two sides and a bottom edge of the mounting plate assembly 40 through both the mounting plate 66 and the cover member 68 by means of which the mounting plate assembly can be secured to the frame. The mounting holes 78 are located in a border region of the assembly 40 and lie outside the aperture 37 in the frame 36 so that the inner surface region of the mounting plate 66 where it extends across the aperture 37 remains unbroken to act as a barrier to prevent any molten fluid which may leak past the tiles 42, the insulation materials 44 and the sensor 46 from contacting the inductor unit.

A plenum 80 is formed integrally as part of an upper, horizontal member of the cover and is arranged to overlie the inlet recess 76 in the mounting plate 66. The plenum is in the form of a triangular housing having an upper surface 82 in which two openings 84 are formed. Means are provided to mount two cooling fans 86 to the upper surface so that air from the fans is directed into the plenum which guides the air into the inlet recess 76 and through the cooling channels 74. In the present embodiment, two cooling fans 86 are provided which are sized so that each fan is capable of generating a sufficient flow of cooling air for the system to operate safely should one fan fail. In this regard, it should be noted that air from either fan 86 is able to flow into all the cooling channels. It will be appreciated that number of cooling fans 86 can be varied in accordance with system requirements.

It is not essential that the cooling fans 86 are located on the mounting plate assembly 40 itself. In some applications it may be desirable to provide a remote source of airflow and to direct the airflow into the cooling channels by means of ducting. This may connect with the plenum 80 whose design can be suitably modified. Indeed, in some applications where forced convection is not required, the cooling fans can be omitted altogether so that natural convection is relied upon to set up a flow of air through the cooling channels. The apparatus can also be modified to use fluids other than air for cooling. This could include other gases or liquids.

In the present embodiment, the rectangular frame portion of the cover assembly 68 has a thickness of about 5 mm so that the main section 40*b* of the mounting plate assembly 40 has an overall thickness of about 25 mm where the cover overlies the mounting plate 66.

A lower horizontal member 88 of the cover 68 overlies a lower end of the mounting plate 66 and end regions 74*a* of the cooling channels 74 opposite from the inlet recess 76. Openings 90 in the lower member 88 align with the end regions 74*a* of the channels 74 to form an outlet for the airflow. A strengthening flange 92 projects outwardly along the lower section 88 of the cover member just above the outlet openings 90. The flange 92 may also serve to deflect the air flowing through the openings 90 away from the induction unit 14.

The further plate 70 is a planar plate which is welded to an upper end of the mounting plate 66 at an angle so as to project under the channel portion 24 of the port 18 in use. The further plate 70 is mounted to the angled portion 36*a* of the frame to close the lower surface of the channel portion 24, supporting the channel section 34*b* of the refractory material and the further insulation plate 44*d*. The further plate 70 also extends over the fans 86 and protects them. The further plate 70 can be omitted where the port 18 is not provided with a channel portion 24 or where the base of the channel portion 24 is closed off by some other means, such as a separate plate.

The rectangular frame of the cover member 68, defines a central rectangular aperture 94 though which part of the cooling channels 74 and the vanes 72 in the mounting plate 66 are exposed. When the induction unit 14 is brought into the operative position, an inner end of the induction unit 14 locates within the aperture 94 so that the inner face 52 of the induction unit is brought into contact with the outer end faces of the vanes 72. In this position, the cooling channels 74 provide an air gap between the face 52 of the induction unit and the solid (i.e. continuous) inner surface region of the mounting plate 66 through which cooling air flows when the fans 86 are operative. This provides forced cooling to reduce the surface temperature of the inductor and the temperature of the mounting plate 66. A flange about the periphery of the induction unit 14 forms a seal with the cover member to prevent the air escaping.

An important aspect of the development of the mounting plate assembly 40 is the need for it to offer minimal opposition to the magnetic field generated by the induction unit 14. In the operative position, the induction unit 14 is in contact with the vanes 72 so that the magnetic field only passes through the mounting plate 66 and not the cover member 68. By machining the mounting plate 66 from a single piece of austenitic steel, complete electromagnetic continuity between the vanes 72 and the inner surface region is ensured. As a result, the mounting plate 66 is relatively unaffected by the magnetic field generated by the induction device 14. This arrangement is highly efficient as no, or only a very limited, magnetic field is induced in the mounting plate 66 so that there is very little energy loss in the magnetic field generated by the induction device 14 as it passes through the mounting plate. It is also advantageous that very little heat is generated in the mounting plate 66 by the electromagnetic field.

Those vanes 72*b*, which occupy a region of the mounting plate 66 through which the magnetic field generated by the induction device passes, follow a non-linear path. As can be seen from FIG. 7, there are nine vanes 72 which define ten channels 74. The two outermost vanes 72*a* are linear. These provide a suitable surface for mounting the inductor face 52 and are positioned outside of the magnetic field generated by the device 14. The two outermost vanes 72*a* lie half under the cover 68 and half exposed inside the aperture 94. With this arrangement, the outer side edges of the induction unit are supported on the exposed half of the vanes 72*a* and the cover 68 is supported on the other half.

The inner seven vanes 72*b* follow a zigzag path over the majority of their length and the apparatus is arranged so that the magnetic field passes though the mounting plate 66 only in the region where the inner vanes are non-linear. Lower end regions 72*c* of the inner vanes 72*b*, which are positioned outside of the magnetic field, are linear. Rather than following a zigzag path, the central vanes 72*b* could follow alternative non-linear paths which may be a curved. The vanes 72*b* could follow a sinusoidal or other wave like path, for example.

The non-linear form of the vanes 72*b* increases the torsional resistance of the mounting plate 66 and is believed to improve transparency to the electromagnetic field when compared with a plate having straight or linear vanes.

In the present embodiment, the mounting plate 66 through which the magnetic field is propagated is produced as a singe integral component to ensure complete electrical continuity. Machining the mounting plate 66 from a single piece of material is also a particularly convenient method of manufacture. However, the mounting plate 66 could be produced by welding separate vanes to a planar plate, provided the welding is of a sufficiently good quality to provide adequate electrically continuity. In an alternative arrangement, a further component or components can be positioned between a planar plate and the induction unit 14 to form the cooling channels. In this arrangement, the plate may be constructed of a non-magnetic metal material, such as austenitic steel, whilst the further component or components may be made of a non-conducting material such as a ceramic, for example.

The present mounting arrangement for the induction unit 14 offers a number of advantages over the prior known mounting arrangements. With the mounting plate assembly 40 in position, the arrangement provides a strong physical barrier between the face 52 of the inductor unit 14 and interior of the port 18 and enables the furnace to be run with or without the inductor 14 in place. This in turn means that the inductor unit 14 can be removed and/or replaced without having to shut the furnace down, thus minimising the inductor change out time. If the furnace is to be run with the inductor unit removed, a cover plate (not shown) can be positioned over the mounting plate 66 to close the outer faces of the cooling channels 74 to enable the cooling system to operate.

The ability to pivot the inductor 14 between an operative and inoperative position using the swing frame 56 provides for safe handling of the inductor unit 14 and enables maintenance work to be carried out on the inductor in-situ. Alternatively the inductor unit 14 can be replaced to enable maintenance/repairs to be carried out at a remote location with minimum downtime of the furnace.

In the event the port 18 itself requires attention, the entire port can be removed from the furnace and placed in a jig in which it can be rotated from its in use position to assist in assembly/disassembly of the various components. As discussed previously, spare ports 18 ready assembled can be provided so that a port 18 can be quickly replaced.

The mounting arrangement described is particularly suitable for use in mounting an induction unit 14 to a vessel for containing molten aluminium (including aluminium alloys) as it is resistant to penetration by molten aluminium. The cooling system, in conjunction with the ceramic tiles and insulation materials, is arranged to position the aluminium freeze plane inboard of the inductor face 52. This prevents molten aluminium coming into contact with the induction unit 14 in the event of a leak through the aperture in the refractory materials.

It will be appreciated, however, that the mounting arrangement can be adapted for use with vessels containing molten materials other than aluminium by appropriate selection of materials and dimension for the various components. Indeed, it will be appreciated that the various components located inboard of the mounting plate 66 can be changed as required by the particular application. For example, the leakage sensor 46 could be omitted and the nature of the insulation materials varied to meet application requirements.

Furthermore, whilst the mounting arrangement is particularly suitable for mounting an induction unit to a port 18 on a furnace, the arrangements disclosed can be adapted to mount an induction unit to any vessel which is used to contain molten materials and could, for example, be used to mount the induction unit directly to a wall or the base of a furnace or indeed any other vessel.

Whereas the invention has been described in relation to what is presently considered to be the most practical and preferred embodiments, it is to be understood that the invention is not limited to the disclosed arrangements but rather is intended to cover various modifications and equivalent constructions included within the spirit and scope of the invention.

Where the terms "comprise", "comprises", "comprised" or "comprising" are used in this specification, they are to be interpreted as specifying the presence of the stated features, integers, steps or components referred to, but not to preclude the presence or addition of one or more other feature, integer, step, component or group thereof.

The invention claimed is:

1. Apparatus for inducing flow in a molten material, the apparatus comprising a refractory lined furnace port having an inclined wall, the refractory lining having a region of reduced thickness; a mounting plate of non-magnetic material removably mounted to the inclined wall of the port extending over the region of reduced thickness in the refractory lining, an electromagnetic induction unit mounted adjacent an exterior face of the mounting plate and a cooling system for cooling the mounting plate.

2. Apparatus as claimed in claim 1, in which the cooling system comprises an arrangement for inducing a flow of cooling fluid between the electromagnetic induction unit and the mounting plate, the cooling system comprising a plurality of cooling channels through which the cooling fluid flows in use.

3. Apparatus as claimed in claim 2, in which a portion of the plate which extends across the region of reduced thickness in the refractory lining has a continuous inner surface region and an outer surface region comprising a plurality of spaced vanes, which define the channels.

4. Apparatus as claimed in claim 3, in which at least some of the vanes follow a non-linear path across an area of the mounting plate through which the magnetic field generated by the induction stirring unit passes in use.

5. Apparatus as claimed in claim 4, in which at least some of the vanes follow a curved or zigzag path across said area.

6. Apparatus as claimed in claim 3, in which the inner surface region and the vanes are integrally formed from a single piece of material.

7. Apparatus as claimed in claim 1, in which the mounting plate is made of austenitic steel.

8. Apparatus as claimed in claim 3, in which the mounting plate forms part of a mounting plate assembly for mounting the induction unit to the port, the mounting plate having a recess in the outer surface region at an inlet end of the fluid-cooling channels arranged so that all the channels are in fluid connection with the recess, the mounting plate assembly including a cowling attached to the mounting plate for directing a flow of fluid into the recess from a fluid-flow source.

9. Apparatus as claimed in claim 3, in which the mounting plate forms part of a mounting plate assembly for mounting the induction unit to the port, the mounting plate assembly comprising a cover member mounted to an outer face of the mounting plate, the cover member defining an aperture through which at least an area of the mounting plate over which the cooling channels and the vanes extend is exposed, the electromagnetic induction unit being received in the aperture so that a face of the unit abuts the vanes.

10. Apparatus as claimed in claim 1, in which the mounting plate forms part of a mounting plate assembly for mounting the induction unit to the vessel, the mounting plate assembly comprising a further plate extending at an angle from one end of the mounting plate.

11. Apparatus as claimed in claim 1, the apparatus comprising a frame mounted to the port about the region of reduced thickness in the refraction lining the mounting plate being removably mounted to the frame to provide an exterior closure for the region of reduced thickness.

12. Apparatus as claimed in claim 11, in which the region of reduced thickness in the refractory lining comprises at least one refractory tile positioned inboard of the mounting plate.

13. Apparatus as claimed in claim 12, in which the, or each, refractory tile is thinner than the refractory lining surrounding the region of reduced thickness.

14. Apparatus as claimed in claim 12, the apparatus further comprising insulation material between the at least one refractory tile and the mounting plate.

15. Apparatus as claimed in claim 1, the apparatus further comprising a framework for mounting the electromagnetic induction unit to the port for pivotal movement between an operative position in which a face of the electromagnetic induction unit is located adjacent the mounting plate and an in operative position in which the electromagnetic induction unit is spaced from the mounting plate.

16. Apparatus as claimed in claim 3, in which a face of the electromagnetic induction unit abuts the vanes when the electromagnetic induction unit is mounted in an operative position.

17. Apparatus as claimed in claim 1, in which the port is removably mountable to a wall of a furnace.

* * * * *